US011821664B2

(12) United States Patent
Nagahata et al.

(10) Patent No.: US 11,821,664 B2
(45) Date of Patent: Nov. 21, 2023

(54) ROTARY COMPRESSOR AND REFRIGERATION CYCLE APPARATUS

(71) Applicant: Toshiba Carrier Corporation, Kawasaki (JP)

(72) Inventors: Taishi Nagahata, Fuji (JP); Hiroyuki Mizuno, Fuji (JP); Masahiro Hatayama, Fuji (JP)

(73) Assignee: TOSHIBA CARRIER CORPORATION, Kawasaki (JP)

( * ) Notice: Subject to any disclaimer, the term of this patent is extended or adjusted under 35 U.S.C. 154(b) by 464 days.

(21) Appl. No.: 17/061,135

(22) Filed: Oct. 1, 2020

(65) Prior Publication Data

US 2021/0018231 A1 Jan. 21, 2021

Related U.S. Application Data

(63) Continuation of application No. PCT/JP2018/014476, filed on Apr. 4, 2018.

(51) Int. Cl.
*F25B 31/02* (2006.01)
*F25B 41/31* (2021.01)
*F25B 37/00* (2006.01)

(52) U.S. Cl.
CPC ..... *F25B 31/026* (2013.01); *F25B 37/00* (2013.01); *F25B 41/31* (2021.01); *F25B 2400/07* (2013.01)

(58) Field of Classification Search
CPC .... F25B 2400/07; F25B 31/026; F25B 37/00; F25B 41/31; F25B 13/00; F04C 29/0021; F04C 2240/40; F04C 2240/80; F04C 18/3564; F04C 23/008
See application file for complete search history.

(56) References Cited

U.S. PATENT DOCUMENTS

2016/0348677 A1 12/2016 Nakano et al.

FOREIGN PATENT DOCUMENTS

| | | | | |
|---|---|---|---|---|
| CN | 100465449 C | * | 3/2009 | ..... F04C 18/3564 |
| CN | 104976118 A | | 5/2015 | |
| CN | 204357704 U | | 5/2015 | |
| CN | 104838145 A | | 8/2015 | |
| CN | 205779699 U | | 12/2016 | |
| JP | 60-135687 A | | 7/1985 | |

(Continued)

OTHER PUBLICATIONS

Dec. 16, 2021 Chinese official action (and English translation thereof) in corresponding Chinese Patent Application No. 201880092147.4.

(Continued)

*Primary Examiner* — Kun Kai Ma
(74) *Attorney, Agent, or Firm* — John P. White

(57) ABSTRACT

According to one embodiment, a rotary compressor includes a compression mechanism unit and an electric motor. The compression mechanism unit includes a first bearing, a second bearing, first to third refrigerant compression units, a second intermediate partitioning panel, and a rotation shaft. The compression mechanism unit is fixed to the sealed container by a pair of fixing units which are provided at two locations spaced apart from each other in the axial direction of the rotation shaft, and the center of gravity of a structure comprising the compression mechanism unit and the rotor of the electric motor is positioned between the pair of fixing units.

7 Claims, 11 Drawing Sheets

(56) References Cited

FOREIGN PATENT DOCUMENTS

| | | | | |
|---|---|---|---|---|
| JP | 5-1686 | A | 1/1993 | |
| JP | 6-26478 | A | 2/1994 | |
| JP | 2005-214129 | A | 8/2005 | |
| JP | 4594302 | B2 | 12/2010 | |
| JP | 2011-64183 | A | 3/2011 | |
| JP | 2014-190175 | A | 10/2014 | |
| JP | 2015-175258 | A | 10/2015 | |
| JP | 2015-203306 | A | 11/2015 | |
| WO | WO 2005/124156 | A1 | 12/2005 | |
| WO | WO-2005124156 | A1 * | 12/2005 | ..... F04C 18/3564 |
| WO | WO-2011033710 | A1 * | 3/2011 | ..... F04C 23/005 |
| WO | WO 2015/111267 | A1 | 7/2015 | |
| WO | WO-2020059096 | A1 * | 3/2020 | ..... F04C 18/3564 |

OTHER PUBLICATIONS

Apr. 27, 2021 Japanese official action (and English translation thereof) in connection with corresponding Japanese Patent Application No. 2020-512171.

Written Opinion dated Jun. 26, 2018 in connection with PCT International Application No. PCT/JP2018/014476.

International Search Report dated Jun. 26, 2018 in connection with PCT International Application No. PCT/JP2018/014476.

* cited by examiner

ROTARY COMPRESSOR AND REFRIGERATION CYCLE APPARATUS

CROSS-REFERENCE TO RELATED APPLICATIONS

This application is a Continuation Application of PCT Application No. PCT/JP2018/014476, filed Apr. 4, 2018, the entire contents of which are incorporated herein by reference.

FIELD

Embodiments described herein relate generally to a rotary compressor of a multi-cylinder type and a refrigeration cycle apparatus comprising the rotary compressor.

BACKGROUND

Recently, a vertical three-cylinder rotary compressor having a compression mechanism unit in which three sets of refrigerant compression units are arranged in the axial direction of a rotary shaft has been developed in order to increase the compression capacity of the refrigerant. The rotating shaft used in this type of rotary compressor comprises first to third crank portions that eccentrically rotate in a cylinder chamber of a refrigerant compression unit, and a pair of middle shaft units located between the first crank portion and the second crank portion and between the second crank portion and the third crank portion.

For this reason, in the three-cylinder rotary compressor, the full length of the rotating shaft is longer and height dimensions of the compression mechanism unit increase as compared with a two-cylinder rotary compressor in which two sets of refrigerant compression units are arranged in the axial direction of the rotating shaft.

Furthermore, since the number of refrigerant compression units increases more than a two-cylinder twin rotary compressor, output of an electric motor needs to be increased and, accordingly, increase in size of the electric motor cannot be avoided.

BRIEF DESCRIPTION OF THE DRAWINGS

FIG. 9 (B) is a side view showing the second intermediate partition plate, illustrating a state where a displacement generated between the pair of plate elements by the second connection pipe pressed into the second suction port is corrected.

DETAILED DESCRIPTION

In the three-cylinder rotary compressor, a heavy large electric motor projects to the upper side of the compression mechanism unit which increases in height dimensions, and a full height of a sealed housing accommodating the compression mechanism unit and the electric motor is increased. For this reason, a position of a center of gravity of the three-cylinder rotary compressor becomes higher and there is a risk that a large vibration may occur during operation.

In general, according to one embodiments, the rotary compressor comprises a cylindrical sealed container; an electric motor including a compression mechanism unit compressing a refrigerant inside the sealed container; and an electric motor including a stator fixed to an inner peripheral surface of the sealed container on an upper side of the compression mechanism unit and a rotor surrounded by the stator to drive the compression mechanism unit inside the sealed container.

The compression mechanism unit comprises a first bearing and a second bearing arranged at intervals in the axial direction of the sealed container, first to third refrigerant compression units arranged at intervals in the axial direction between the first bearing and the second bearing, a first intermediate partition plate interposed between the first refrigerant compression unit and the second refrigerant compression unit, a second intermediate partition plate interposed between the second refrigerant compression unit and the third refrigerant compression unit, and a rotating shaft to which the rotor of the electric motor is fixed.

The rotating shaft includes a first journal portion supported by the first bearing, a second journal portion supported by the second bearing, the first to third crank portions provided between the first journal portion and the second journal portion, eccentrically rotating in the cylinder chambers of the first to third refrigerant compression portions and having rollers fitted therewith, a first intermediate shaft portion located between the first crank portion and the second crank portion, and a second intermediate shaft portion located between the second crank portion and the third crank portion.

The compression mechanism unit is fixed to the sealed container by a pair of fixing portions provided at two parts spaced apart in the axial direction of the rotating shaft, and a center of gravity of a structure including the compression mechanism unit and the rotor of the electric motor between the pair of fixing portions.

First Embodiment

The first embodiment will be described hereinafter with reference to FIG. 1 to FIG. 10.

Figure 1:
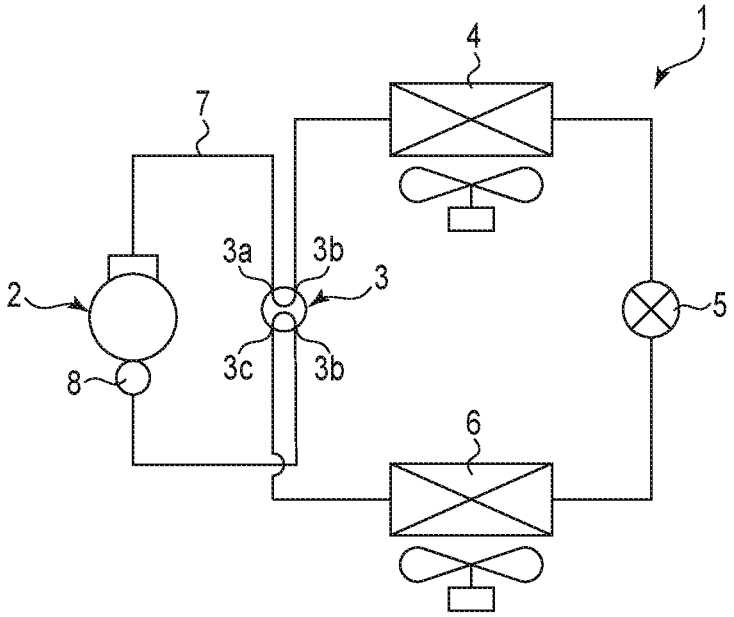
FIG. 1 is a circuit diagram schematically showing a structure of a refrigeration cycle apparatus according to a first embodiment.

FIG. 1 is a refrigeration cycle circuit diagram of an air conditioner 1, which is an example of, for example, a refrigeration cycle apparatus. The air conditioner 1 comprises a rotary compressor 2, a four-way valve 3, an outdoor heat exchanger 4, an expansion device 5, and an indoor heat exchanger 6 as main elements. The plurality of elements constituting the air conditioner 1 are connected via a circulation circuit 7 in which the refrigerant circulates.

More specifically, as shown in FIG. 1, a discharge side of the rotary compressor 2 is connected to a first port 3*a* of a four-way valve 3. A second port 3*b* of the four-way valve 3 is connected to the outdoor heat exchanger 4. The outdoor heat exchanger 4 is connected to the indoor heat exchanger 6 via the expansion device 5. The indoor heat exchanger 6 is connected to a third port 3*c* of the four-way valve 3. A fourth port 3*d* of the four-way valve 3 is connected to a suction side of the rotary compressor 2 via an accumulator 8.

When the air conditioner 1 operates in a cooling mode, the four-way valve 3 is switched such that the first port 3*a* communicates with the second port 3*b* and the third port 3*c* communicates with the fourth port 3*d*. When the operation of the air conditioner 1 is started in a cooling mode, a high-temperature and high-pressure vapor-phase refrigerant compressed by the rotary compressor 2 is led to the outdoor heat exchanger 4 which functions as radiator (condenser) via the four-way valve 3.

The vapor-phase refrigerant led to the outdoor heat exchanger 4 is condensed by heat exchange with the air, and changed into a high-pressure liquid-phase refrigerant. The high-pressure liquid-phase refrigerant is reduced in pressure in a process of passing through the expansion device 5 and is changed to a low-pressure gas-liquid two-phase refrigerant. The gas-liquid two-phase refrigerant is led to the indoor heat exchanger 6 which functions as a heat absorber (evaporator), and exchanges heat with air in a process of passing through the indoor heat exchanger 6.

As a result, the gas-liquid two-phase refrigerant takes heat from the air, evaporates, and changes to a low-temperature and low-pressure vapor-phase refrigerant. The air passing through the indoor heat exchanger 6 is cooled by the latent heat of vaporization of the liquid-phase refrigerant and is sent to a place to be air-conditioned (cooled) as cold air.

The low-temperature and low-pressure vapor-phase refrigerant passing through the indoor heat exchanger 6 is led to the accumulator 8 via the four-way valve 3. When the liquid-phase refrigerant which could not evaporate is mixed in the refrigerant, the refrigerant is separated into liquid-phase refrigerant and vapor-phase refrigerant in the accumulator 8. The low-temperature and low-pressure vapor-phase refrigerant from which the liquid-phase refrigerant has been separated is sucked into the rotary compressor 2 and is compressed again into the high-temperature and high-pressure vapor-phase refrigerant by the rotary compressor 2 and discharged to the circulation circuit 7.

In contrast, when the air conditioner 1 operates in a heating mode, the four-way valve 3 switches such that the first port 3*a* communicates with third port 3*c* and the second port 3*b* communicates with the fourth port 3*d*. For this reason, the high-temperature and high-pressure vapor-phase refrigerant discharged from the rotary compressor 2 is led to the indoor heat exchanger 6 via the four-way valve 3 and exchanges heat with air passing through the indoor heat exchanger 6. That is, the indoor heat exchanger 6 functions as a condenser.

As a result, the vapor-phase refrigerant passing through the indoor heat exchanger 6 is condensed by heat exchange with the air, and changed into a high-pressure liquid-phase refrigerant. The air passing through the indoor heat exchanger 6 is heated by heat exchange with the vapor-phase refrigerant and is sent to a place to be air-conditioned (heated) as warm air.

The high-temperature liquid-phase refrigerant that has passed through the indoor heat exchanger 6 is led to the expansion device 5 and is reduced in pressure in a process of passing through the expansion device 5 and changes into a low-pressure gas-liquid two-phase refrigerant. The gas-liquid two-phase refrigerant is led to the outdoor heat exchanger 4 which functions as an evaporator, and evaporates by exchanging heat with air, and changes to a low-temperature and low-pressure vapor-phase refrigerant. The low-temperature and low-pressure vapor-phase refrigerant that has passed through the outdoor heat exchanger 4 is sucked into the rotary compressor 2 via the four-way valve 3 and the accumulator 8.

Figure 2:
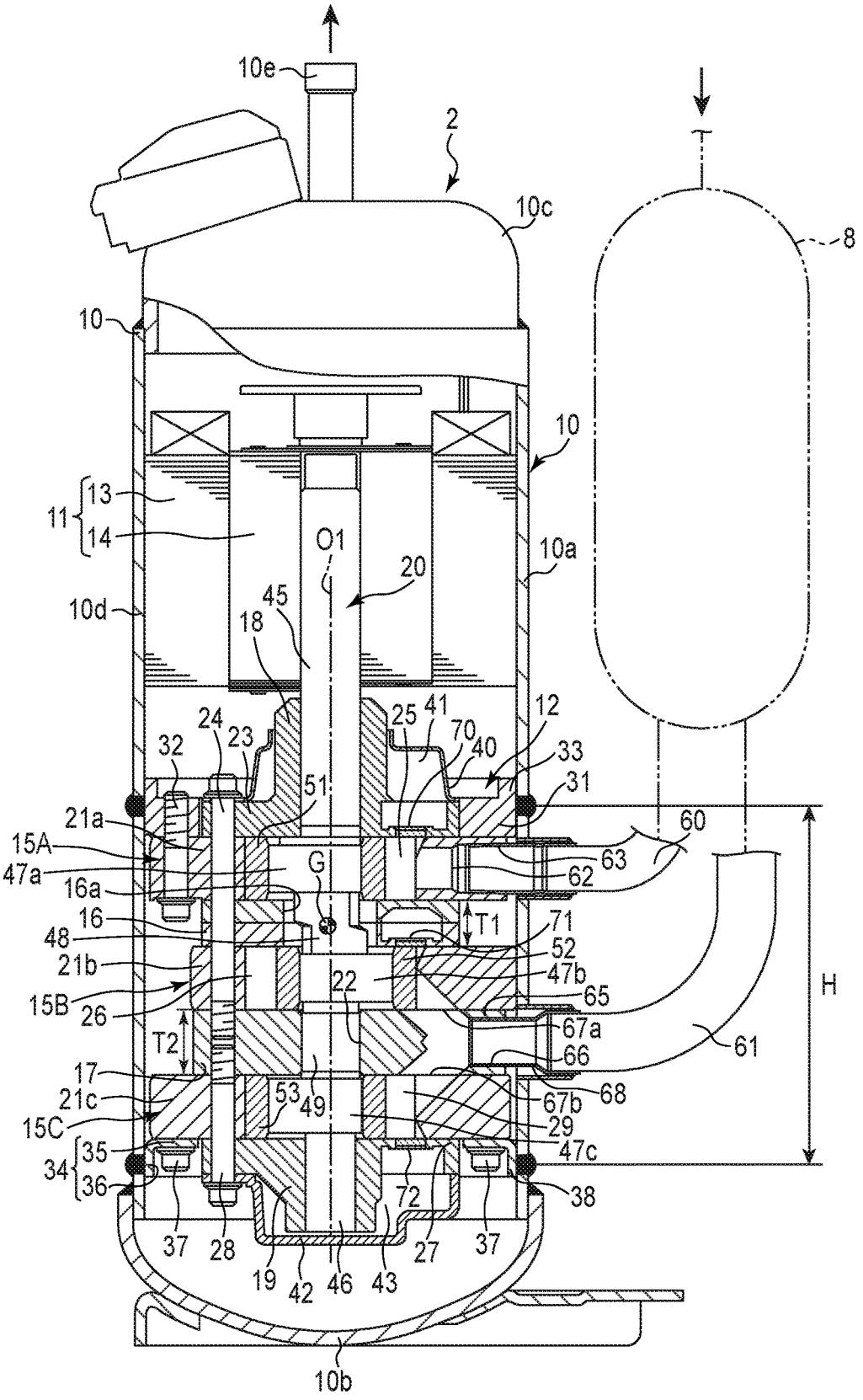
FIG. 2 is a cross-sectional view showing a three-cylinder rotary compressor according to a first embodiment.

Next, a concrete configuration of the rotary compressor 2 used in the air conditioner 1 will be described with reference to FIG. 2 to FIG. 8. FIG. 2 is a cross-sectional view showing the vertical three-cylinder rotary compressor 2. As shown in FIG. 2, the three-cylinder rotary compressor 2 comprises a sealed container 10, an electric motor 11, and a compression mechanism unit 12 as main elements.

The sealed container 10 is divided into, for example, three elements, i.e., a container body 10*a*, a bottom member 10*b*, and a lid member 10*c*. The container body 10*a* has a cylindrical peripheral wall 10*d* and is erected along the vertical direction. The bottom member 10*b* is welded to a lower end of the container body 10*a* so as to airtightly close a lower end opening of the container body 10*a*. The lid member 10*c* is welded to an upper end of the container body 10*a* so as to airtightly close an upper end opening of the container body 10*a*.

A discharge pipe 10*e* is attached to the lid member 10*c* of the sealed container 10. The discharge pipe 10*e* is connected to the first port 3*a* of the four-way valve 3 via the circulation circuit 7. Furthermore, a lubricating oil that lubricates the compression mechanism unit 12 is stored in a lower part of the sealed container 10.

The electric motor 11 is accommodated in an intermediate portion along the axial direction of the sealed container 10 so as to be positioned above the oil level of the lubricating oil. The electric motor 11 is a so-called inner rotor type motor, and comprises a stator 13 and a rotor 14. The stator 13 is fixed to an inner surface of a peripheral wall 10*d* of the container body 10*a*. The rotor 14 is coaxially positioned on a central axis of the sealed container 10 and is surrounded by the stator 13.

The compression mechanism unit 12 is accommodated in the lower part of the sealed container 10 so as to be immersed in the lubricating oil. The compression mechanism unit 12 comprises a first refrigerant compression unit 15A, a second refrigerant compression unit 15B, a third refrigerant compression unit 15C, a first intermediate partition plate 16, a second intermediate partition plate 17, a first bearing 18, a second bearing 19, and a rotating shaft 20 as main elements.

The first to third refrigerant compression units 15A, 15B, and 15C are arranged at intervals in a line in the axial direction of the sealed container 10. The first to third refrigerant compression units 15A, 15B, and 15C have a first cylinder body 21*a*, a second cylinder body 21*b*, and a third cylinder body 21*c*, respectively. For example, the first to third cylinder bodies 21*a*, 21*b*, and 21*c* are set to have the same thickness along the axial direction of the sealed container 10.

The first intermediate partition plate 16 is interposed between the first cylinder body 21*a* and the second cylinder body 21*b*. An upper surface of the first intermediate partition plate 16 is overlaid on a lower surface of the first cylinder body 21*a* so as to cover an inner diameter portion of the first cylinder body 21*a* from below. A lower surface of the first intermediate partition plate 16 is overlaid on an upper surface of the second cylinder body 21*b* so as to cover an inner diameter portion of the second cylinder body 21*b* from above.

Furthermore, a through hole 16*a* is formed in a central portion of the first intermediate partition plate 16. The through hole 16*a* is located between the inner diameter portion of the first cylinder body 21*a* and the inner diameter portion of the second cylinder body 21*b*.

The second intermediate partition plate 17 is interposed between the second cylinder body 21*b* and the third cylinder body 21*c*. An upper surface of the second intermediate partition plate 17 is overlaid on a lower surface of the second cylinder body 21*b* so as to cover the inner diameter portion of the second cylinder body 21*b* from below. A lower surface of the second intermediate partition plate 17 is overlaid on an upper surface of the third cylinder body 21*c* so as to cover an inner diameter portion of the third cylinder body 21*c* from above.

Furthermore, a circular bearing hole 22 is formed in a central portion of the second intermediate partition plate 17. The bearing hole 22 is located between the inner diameter portion of the second cylinder body 21*b* and the inner diameter portion of the third cylinder body 21*c*.

The first intermediate partition plate 16 and the second intermediate partition plate 17 have thicknesses T1 and T2 along the axial direction of the sealed container 10, respectively. According to the present embodiment, the thickness T2 of the second intermediate partition plate 17 is larger than the thickness T1 of the first intermediate partition plate 16.

As shown in FIG. 2, the first bearing 18 is positioned on the first cylinder body 21*a*. The first bearing 18 has a flange portion 23 projecting toward the peripheral wall 10*d* of the container body 10*a*. The flange portion 23 is overlaid on the upper surface of the first cylinder body 21*a* so as to cover the inner diameter portion of the first cylinder body 21*a* from above.

The flange portion 23 of the first bearing 18, the first cylinder body 21*a*, the first intermediate partition plate 16, the second cylinder body 21*b*, and the second intermediate partition plate 17 are stacked in the axial direction of the sealed container 10, and are integrally connected via a plurality of first fastening bolts 24 (only one is shown).

A region surrounded by the inner diameter portion of the first cylinder body 21*a*, the first intermediate partition plate 16, and the flange portion 23 of the first bearing 18 defines a first cylinder chamber 25. A region surrounded by the inner diameter portion of the second cylinder body 21*b*, the first intermediate partition plate 16, and the second intermediate partition plate 17 defines a second cylinder chamber 26.

The second bearing 19 is positioned below the third cylinder body 21*c*. The second bearing 19 has a flange portion 27 protruding toward the peripheral wall 10*d* of the container body 10*a*. The flange portion 27 is overlaid on the lower surface of the third cylinder body 21*c* so as to cover the inner diameter portion of the third cylinder body 21*c* from below.

The flange portion 27 of the second bearing 19, the third cylinder body 21*c*, and the second intermediate partition plate 17 are stacked in the axial direction of the sealed container 10 and are integrally connected via a plurality of second fastening bolts 28 (only one shown). A region surrounded by the inner diameter portion of the third cylinder body 21 *c*, the second intermediate partition plate 17, and the flange portion 27 of the second bearing 19 defines a third cylinder chamber 29.

Accordingly, the first bearing 18 and the second bearing 19 are separated from each other in the axial direction of the sealed container 10, and the first to third cylinder bodies 21*a*, 21*b*, and 21*c*, the first intermediate partition plate 16 and the second intermediate partition plate 17 are alternately positioned between the first bearing 18 and the second bearing 19.

According to the present embodiment, the flange portion 23 of the first bearing 18 is surrounded by a ring-shaped first support member 31. The first support member 31 has a thickness equivalent to the flange portion 23 of the first bearing 18. The lower surface of the first support member 31 is overlaid on the upper surface of an outer peripheral portion of the first cylinder body 21*a* closest to the electric motor 11. The first support member 31 and the outer peripheral portion of the first cylinder body 21*a* are firmly coupled via a plurality of third fastening bolts 32 (only one shown).

Furthermore, the outer peripheral portion of the first support member 31 is extended upward of the container body 10*a* in order to ensure a contact area with the inner surface of the peripheral wall 10*d* of the container body 10*a*. The outer peripheral portion of the first support member 31 is fixed to a predetermined position of the container body 10*a* by means such as welding. For this reason, the first support member 31 welded to the container body 10*a* constitutes a first fixing portion 33 that fixes the upper end part of the compression mechanism portion 12 to the sealed container 10.

As shown in FIG. 2, the outer peripheral portion of the third cylinder body 21*c* projects outward from the flange portion 27 of the second bearing 19 along the radial direction of the sealed container 10. A ring-shaped second support member 34 is attached to the lower surface of the outer peripheral portion of the third cylinder body 21*c* farthest from the electric motor 11. The second support member 34 comprises a flat ring portion 35 that receives the lower surface of the outer peripheral portion of the third cylinder body 21*c*, and a cylindrical fitting portion 36 that is folded downward from the outer peripheral edge of the ring portion 35.

The ring portion 35 is coupled to the lower surface of the outer peripheral portion of the third cylinder body 21*c* via a plurality of fourth fastening bolts 37. The fitting portion 36 is fitted inside the peripheral wall 10*d* of the container body 10*a*, and the fitting portion 36 is fixed to a predetermined position of the container body 10*a* by means such as welding.

For this reason, the second support member 34 welded to the container body 10*a* constitutes a second fixing portion 38 that fixes the lower end part of the compression mechanism portion 12 to the sealed container 10. The second fixing portion 38 is separated from the first fixing portion 33 by a distance H in the axial direction of the sealed container 10.

A first discharge muffler 40 is attached to the first bearing 18. A first silencing chamber 41 is formed between the first discharge muffler 40 and the first bearing 18. The first silencing chamber 41 is opened inside the sealed container 10 through an exhaust hole (not shown) of the first discharge muffler 40.

The second discharge muffler 42 is attached to the second bearing 19. A second silencing chamber 43 is formed between the second discharge muffler 42 and the second bearing 19. The second silencing chamber 43 communicates with the first silencing chamber 41 via a discharge passage (not shown) extending in the axial direction of the sealed container 10.

As shown in FIG. 2, the rotating shaft 20 is coaxially positioned on the central axis of the sealed container 10. The rotating shaft 20 is an integrated structure having a first journal portion 45, a second journal portion 46, first to third crank portions 47*a*, 47*b*, and 47*c*, a first intermediate shaft portion 48, and a second intermediate shaft portion 49.

The first journal portion 45 is positioned at an intermediate portion along the axial direction of the rotating shaft 20 and is rotatably supported by the first bearing 18. The rotor 14 of the electric motor 11 is fixed to an upper end part of the rotating shaft 20 protruding from the first bearing 18.

The second journal portion 46 is provided coaxially with the first journal portion 45 so as to be positioned at the lower end part of the rotating shaft 20. The second journal portion 46 is rotatably supported by the second bearing 19.

The first to the third crank portions 47*a*, 47*b*, and 47*c* are located between the first journal portion 45 and the second journal portion 46 and are arranged at intervals in the axial direction of rotating shaft 20. The first to third crank portions 47*a*, 47*b*, and 47*c* are disk-shaped elements each having a circular cross-sectional shape and, in the present embodiment, the thickness dimension and the diameter along the axial direction of the rotating shaft 20 are set to be the same.

The first to third crank portions 47*a*, 47*b*, and 47*c* are eccentric with respect to a rotation center line O1 of the rotating shaft 20, and the eccentric directions are shifted by 120° in a circumferential direction of the rotating shaft 20. The first crank portion 47*a* is located in the first cylinder chamber 25. The second crank portion 47*b* is located in the second cylinder chamber 26. The third crank portion 47*c* is located in the third cylinder chamber 29.

The first intermediate shaft portion 48 is located between the first crank portion 47*a* and the second crank portion 47*b* on the rotation center line O1 of the rotating shaft 20, and penetrates the through hole 16*a* of the first intermediate partition plate 16.

The second middle shaft 49 is located between the second crank portion 47*b* and the third crank portion 47*c* on the rotation center line O1 of the rotating shaft 20, and is slidably fitted in the bearing hole 22 of the second intermediate partition plate 17 in the shaft circumference direction. By this fitting, the second intermediate partition plate 17 also functions as a third bearing that supports the rotating shaft 20 between the first bearing 18 and the second bearing 19.

A ring-shaped roller 51 is fitted in the outer peripheral surface of the first crank portion 47*a*. The roller 51 follows the rotating shaft 20 and eccentrically rotates in the first cylinder chamber 25, and a part of the outer peripheral surface of the roller 51 brings is slidably in line contact with the inner peripheral surface of the inner diameter portion of the first cylinder body 21*a*.

An upper end surface of the roller 51 is slidably in contact with the lower surface of the flange 23 of the first bearing 18. A lower end surface of the roller 51 is slidably in contact with the upper surface of the first intermediate partition plate 16. The airtightness of the first cylinder chamber 25 is thereby secured.

A ring-shaped roller 52 is fitted in the outer peripheral surface of the second crank portion 47*b*. The roller 52 follows the rotating shaft 20 and eccentrically rotates in the second cylinder chamber 26, and a part of the outer peripheral surface of roller 52 brings is slidably in line contact with the inner peripheral surface of the inner diameter portion of the second cylinder body 21*b*.

The upper end surface of the roller 52 is slidably in contact with the under surface of the first intermediate partition plate 16. The lower end surface of the roller 52 is slidably in contact with the upper surface of the second intermediate partition plate 17. The airtightness of the second cylinder chamber 26 is thereby secured.

A ring-shaped roller 53 is fitted in the outer peripheral surface of the third crank portion 47*c*. The roller 53 follows the rotating shaft 20 and eccentrically rotates in the third cylinder chamber 29, and a part of the outer peripheral surface of roller 53 brings is slidably in line contact with the inner peripheral surface of the inner diameter portion of third cylinder body 21*c*.

The upper end surface of roller 53 is slidably in contact with the under surface of the second intermediate partition plate 17. The lower end surface of the roller 53 is slidably in contact with the upper surface of flange 27 of the second bearing 19. The airtightness of the third cylinder chamber 29 is thereby secured.

Figure 3:
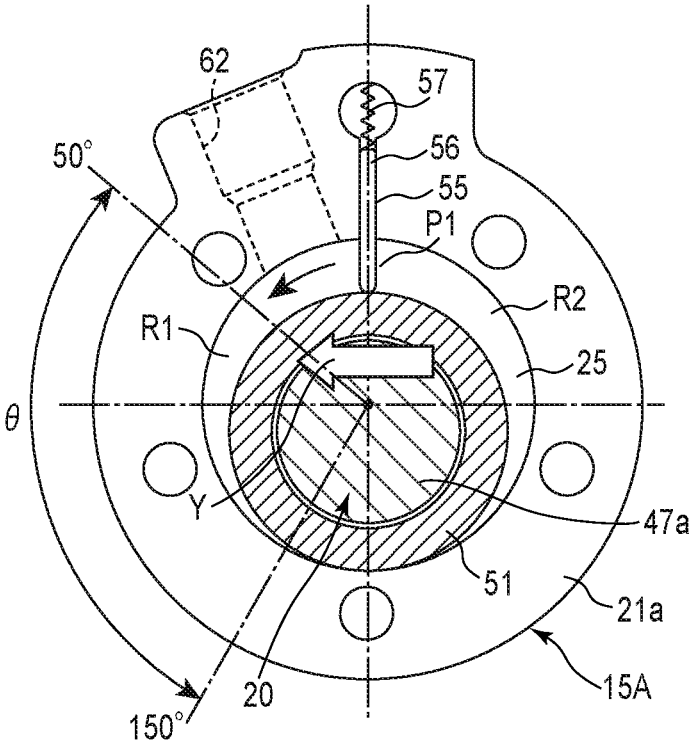
FIG. 3 is a cross-sectional view showing a first refrigerant compression unit, schematically illustrating a positional relationship between a vane and a roller.
Figure 4:
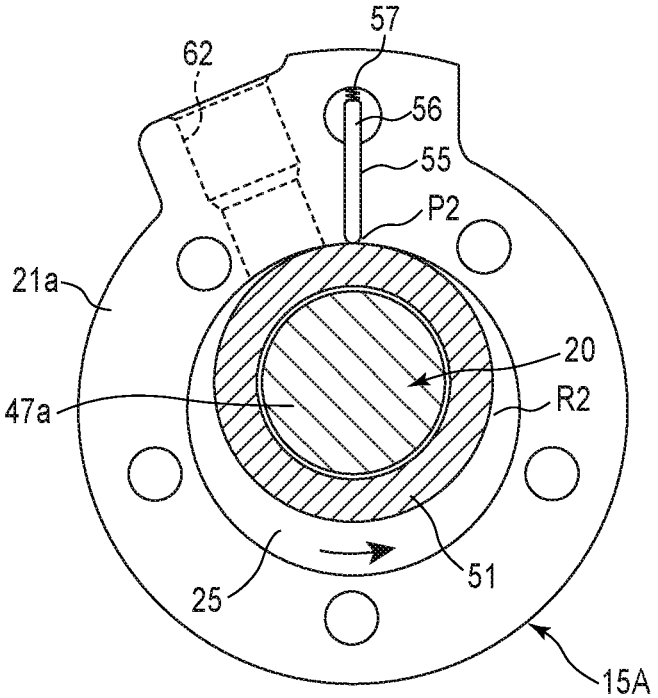
FIG. 4 is a cross-sectional view showing a first refrigerant compression unit, illustrating a relative positional relationship between a roller and a vane in a first cylinder chamber when a rotary angle of a crank portion of the rotary shaft is 0°.
Figure 5:
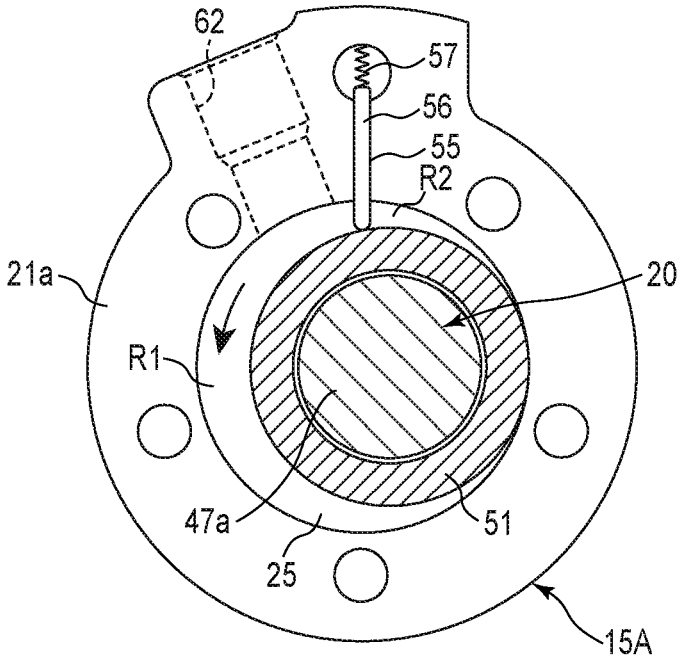
FIG. 5 is a cross-sectional view showing a first refrigerant compression unit, illustrating a relative positional relationship between a roller and a vane in the first cylinder chamber when a rotary angle of a crank portion of the rotary shaft is 270°.

As shown in FIG. 3 to FIG. 5 as a representative of the first cylinder body 21*a*, vane slots 55 are formed in the first to third cylinder bodies 21*a*, 21*b*, and 21*c*, respectively. The vane slot 55 extends to the radial direction of the first cylinder chamber 25.

A vane 56 is accommodated in the vane slot 55. The vane 56 is movable along the vane slot 55 in the radial direction of the first cylinder chamber 25 and is urged toward the first cylinder chamber 25 via a spring 57. A tip of the vane 56 is slidably pressed against the outer peripheral surface of the roller 51.

The vane 56 divides the first cylinder chamber 25 into a suction region R1 and a compression region R2 in cooperation with the roller 51. Furthermore, the vane 56 can reciprocate between a protruding position P1 and an immersion position P2 following the eccentric rotation of the roller 51.

FIG. 3 discloses a state in which the vane 56 is moved to the protruding position P1. At the protruding position P1, the vane 56 protrude most into the first cylinder chamber 25. At the immersion position P2, the vane 56 is pushed into the vane slot 55 so as to retreat from the first cylinder chamber 25. As a result, when the roller 51 rotates eccentrically, the volumes of the suction region R1 and the compression region R2 of the first cylinder chamber 25 change continuously.

Although not shown, the second cylinder chamber 26 and the third cylinder chamber 29 are also divided into a suction region and a compression region by the same vane. For this reason, when the rollers 52 and 53 eccentrically rotate, the volumes of the suction region and the compression region in the second cylinder chamber 26 and the third cylinder chamber 29 change continually.

As shown in FIG. 2, the first cylinder chamber 25 is connected to the accumulator 8 via a first suction pipe 60.

The second cylinder chamber 26 and third cylinder chamber 29 are connected to the accumulator 8 via the second intermediate partition plate 17 and a second suction pipe 61.

More specifically, as shown in FIG. 3, a first suction port 62 that is continuous with the suction region R1 of the first cylinder chamber 25 is formed in the first cylinder body 21*a*. The first suction port 62 is opened on the outer surface of the first cylinder body 21*a* and extends from the opening end toward the center of the first cylinder chamber 25.

Furthermore, a first connection pipe 63 is press-fitted from the outside of the first cylinder body 21*a* into the first suction port 62. The first connecting pipe 63 penetrates the peripheral wall 10*d* of the container body 10*a* and protrudes out of the sealed container 10, and a downstream end of the first suction pipe 60 is inserted airtight into the inside of the first connecting pipe 63.

Figure 6:
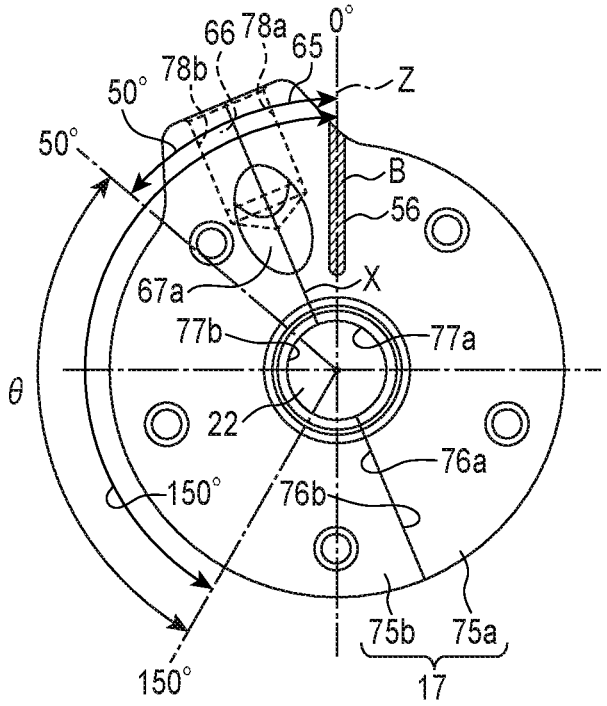
FIG. 6 is a plan view showing a second intermediate partition plate.

As shown in FIG. 6, a joint portion 65 is formed on a part of the outer peripheral portion of the second intermediate partition plate 17. The joint portion 65 protrudes from the outer peripheral portion of the second intermediate partition plate 17 toward the peripheral wall 10*d* of the container main body 10*a*. A second suction port 66 and two branch passages 67*a* and 67*b* branched in a bifurcated manner from the downstream end of the second suction port 66 are formed inside the joint portion 65.

The second suction port 66 is opened at the protruding end of the joint portion 65 and extends from the protruding end toward the center of the second intermediate partition plate 17. Furthermore, a second connection pipe 68 is press-fitted into the second suction port 66 from the outside of the second intermediate partition plate 17. The second connecting pipe 68 penetrates the peripheral wall 10*d* of the container body 10*a* and protrudes out of the sealed container 10, and a downstream end of the second suction pipe 61 is inserted airtight into the inside of the second connecting pipe 68.

One branch passage 67*a* is opened on the upper surface of the second intermediate partition plate 17 so as to communicate with the second cylinder chamber 26. The other branch passage 67*b* is opened on the lower surface of the second intermediate partition plate 17 so as to communicate with the third cylinder chamber 29.

As shown in FIG. 2, a first discharge valve 70 that opens when the pressure in the compression region R2 of the first cylinder chamber 25 reaches a predetermined value is provided in the flange portion 23 of the first bearing 18. The discharge side of the first discharge valve 70 communicates with the first silencing chamber 41.

A second discharge valve 71 that opens when the pressure in the compression region R2 of the second cylinder chamber 26 reaches a predetermined value is provided in the first intermediate partition plate 16. The discharge side of the second discharge valve 71 communicates with the first silencing chamber 41 through a discharge passage (not shown) provided in the first intermediate partition plate 16 and in the first cylinder body 21*a*.

A third discharge valve 72 that opens when the pressure in the compression region R2 of the third cylinder chamber 29 reaches a predetermined value is provided in the flange portion 27 of the second bearing 19. The discharge side of the third discharge valve 72 communicates with the second silencing chamber 43.

In such a three-cylinder rotary compressor 2, when the rotating shaft 20 is rotated by the electric motor 11, the rollers 51, 52, and 53 follow the first to third crank portions 47*a*, 47*b*, and 47*c* and eccentrically rotate in the first to third cylinder chambers 25, 26, and 29. As a result, the volumes of the suction region R1 and the compression region R2 of the first to third cylinder chambers 25, 26, and 29 change, and the vapor-phase refrigerant in the accumulator 8 is sucked from the first suction pipe 60 and the second suction pipe 61 into the suction region R1 of the first to third cylinder chambers 25, 26, and 29.

The vapor-phase refrigerant sucked into the suction region R1 of the first cylinder chamber 25 from the first suction pipe 60 through the first suction port 62 is gradually compressed in a process in which the suction region R1 moves to the compression region R2. When the pressure of the vapor-phase refrigerant reaches a predetermined value, the first discharge valve 70 is opened, and the vapor-phase refrigerant compressed in the first cylinder chamber 25 is discharged into the first silencing chamber 41.

Part of the vapor-phase refrigerant led from the second suction pipe 61 to the second suction port 66 of the second intermediate partition plate 17 is sucked into the suction region R1 of the second cylinder chamber 26 through the branch passage 67*a*. The vapor-phase refrigerant sucked into the suction region R1 of the second cylinder chamber 26 is gradually compressed in the process in which the suction region R1 moves to the compression region R2. When the pressure of the vapor-phase refrigerant reaches a predetermined value, the second discharge valve 71 is opened, and the vapor-phase refrigerant compressed in the second cylinder chamber 26 is led to the first silencing chamber 41 through a discharge passage.

The remaining vapor-phase refrigerant led to the second suction opening 66 of the second intermediate partition plate 17 from the second suction pipe 61 is sucked into the suction region R1 of the third cylinder chamber 29 through the other branch passage 67*b*. The vapor-phase refrigerant sucked into the suction region R1 of the third cylinder chamber 29 is gradually compressed in the process in which the suction region R1 moves to the compression region R2. When the pressure of the vapor-phase refrigerant reaches a predetermined value, the third discharge valve 72 is opened, and the vapor-phase refrigerant compressed in the third cylinder chamber 29 is discharged into the second silencing chamber 43. The vapor-phase refrigerant discharged into the second silencing chamber 43 is led to the first silencing chamber 41 through a discharge passage.

The eccentric directions of the first to third crank portions 47*a*, 47*b*, and 47*c* of the rotating shaft 20 are shifted by 120° in the circumferential direction of the rotating shaft 20. For this reason, there is a phase difference equivalent to the timing at which the vapor-phase refrigerants compressed in the first to third cylinder chambers 25, 26, and 29 are discharged.

The vapor-phase refrigerants compressed in the first to third cylinder chambers 25, 26, and 29 merge in the first silencing chamber 41 and are continuously discharged from the exhaust hole of the first discharge muffler 40 to the inside of the sealed container 10. After having passed through the electric motor 11, the vapor-phase refrigerant discharged into the sealed container 10 is led to the four-way valve 3 from the discharge pipe 10*e*.

In the three-cylinder rotary compressor 2 of the present embodiment, the upper end part of the compression mechanism portion 12 having the first to third refrigerant compression units 15A, 15B, and 15C is fixed to the sealed container 10 by the first fixing portion 33, and the lower end part of the compression mechanism unit 12 is fixed to the sealed container 10 by the second fixing portion 38.

That is, the compression mechanism unit 12 is fixed to the sealed container 10 at two locations spaced in the axial direction of the rotating shaft 20, and the first fixing portion 33 and the second fixing portion 38 are separated by distance H in the axial direction of the rotating shaft 20.

Furthermore, in the present embodiment, the center of gravity G of the structure including the rotor 14 of the electric motor 11 and the compression mechanism unit 12 is located within the range of the distance H between the fixing portion 33 and the second fixing portion 38 by, for example, optimizing the weight distribution of various components constituting the compression mechanism unit 12. More specifically, as shown in FIG. 2, the center of gravity G is located on the axis of the first intermediate shaft portion 48 straddling between the first crank portion 47*a* and the second crank portion 47*b*.

On the other hand, in the three-cylinder rotary compressor 2 of the present embodiment, the suction region R1 of the second cylinder chamber 26 and the third cylinder chamber 29 is connected to the accumulator 8 through the second suction port 66 provided in the second intermediate partition plate 17 and the branch passages 67*a* and 67*b*.

For this reason, the second cylinder chamber 26 and third cylinder chamber 29 inevitably have a longer refrigerant suction path than the first cylinder chamber 25. Therefore, in order to make the pressure loss that occurs when the second cylinder chamber 26 and the third cylinder chamber 29 are in the suction stroke equal to the pressure loss that occurs in the first cylinder chamber 25, the volume of the refrigerant suction path as a whole needs to be larger.

As a result, the thickness T2 of the second intermediate partition plate 17 having the second suction port 66 and the branch passages 67*a* and 67*b* is increased, and the entire length of the second intermediate shaft portion 49 extending between the second crank portion 47*b* and the third crank portion 47*c* becomes longer accordingly.

Therefore, in the present embodiment, in order to suppress the bending of the rotating shaft 20, the bearing hole 22 that rotatably supports the second intermediate shaft portion 49 is formed in the second intermediate partition plate 17, and the second intermediate partition plate 17 also functions as a third bearing that supports the rotary shaft 20.

In this case, since the rotary shaft 20 is an integral structure, the second intermediate shaft portion 49 of the rotating shaft 20 cannot be fitted into the bearing hole 22 of the second intermediate partition plate 17 unless the second intermediate partition plate 17 is divided.

Figure 7:
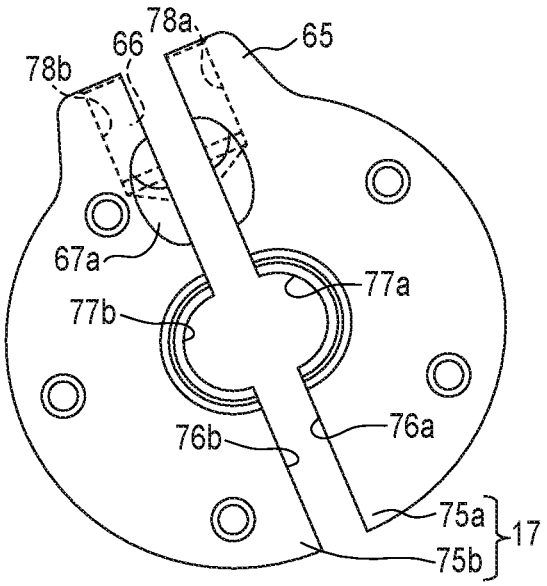
FIG. 7 is a plan view showing a state in which the second intermediate partition plate is divided into a pair of plate elements.
Figure 8:
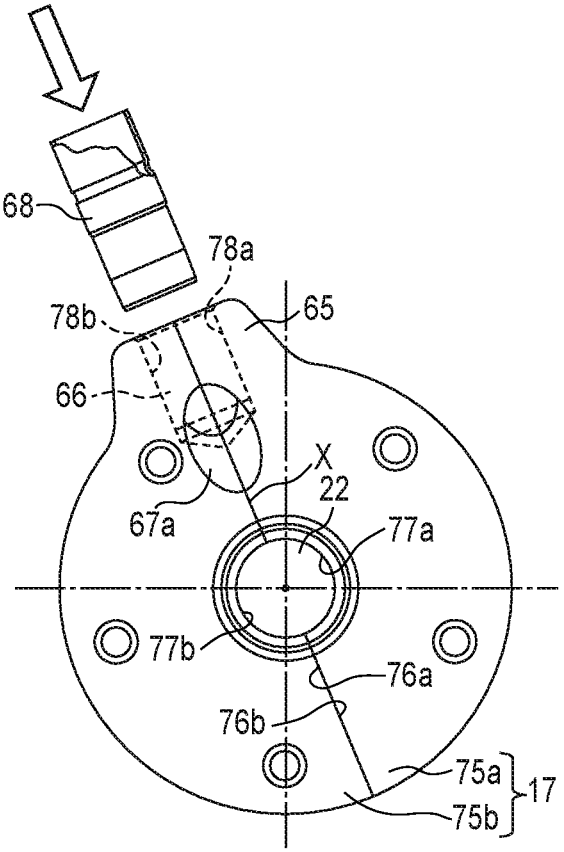
FIG. 8 is a plan view showing a positional relationship between a second suction port of a second intermediate partition plate and a second connection pipe.

Therefore, in the present embodiment, as shown in FIG. 6 to FIG. 8, the second intermediate partition plate 17 is divided into a first plate element 75*a* and a second plate element 75*b* along a radial direction of the second intermediate shaft portion 49. The first plate element 75*a* and the second plate element 75*b* have perpendicular bonding surfaces 76*a* and 76*b* along the axial direction of the second intermediate shaft portion 49, respectively. The bonding surfaces 76*a* and 76*b* are made to abut on each other and define a straight line-shaped dividing line X. The dividing line X extends in the radial direction of the second intermediate partition plate 17 so as to connect, for example, the center of the second suction port 66 and the center of the bearing hole 22.

As shown in FIG. 7, first recess portions 77*a* and 77*b* that are curved in an arc shape are formed on the first plate element 75*a* and the second plate element 75*b*, respectively. When the bonding surface 76*a* of the first plate element 75*a* and the bonding surface 76*b* of the second plate element 75*b* are made to abut, the first recess portions 77*a* and 77*b* cooperate to define the bearing hole 22.

For this reason, when the bonding surface 76*a* of the first plate element 75*a* and the bonding surface 76*b* of the second plate element 75*b* are made to abut, the second intermediate shaft portion 49 of the rotary shaft 20 sandwiched between the first recess portions 77*a* and 77*b* from the radial direction, such that the second intermediate shaft portion 49 is slidably inserted into the bearing hole 22.

Furthermore, second recess portions 78*a* and 78*b* that are curved in an arc shape are formed at end portions of the bonding surfaces 76*a* and 76*b* of the first plate element 75*a* and the second plate element 75*b*, respectively. When the bonding surface 76*a* of the first plate element 75*a* and the bonding surface 76*b* of the second plate element 75*b* are made to abut, the second recess portions 78*a* and 78*b* cooperate to define the second suction port 66. For this reason, the second connection pipe 68 is press-fitted between the second recess portions 78*a* and 78*b*, and the outer peripheral surface of the second connection pipe 68 is in contact with the inner peripheral surfaces of the second recess portions 78*a* and 78*b*.

In addition, the branch passages 67*a* and 67*b* of the second intermediate partition plate 17 are positioned on the dividing line X, and parts of the second recess portions 78*a* and 78*b* constitute the branch passages 67*a* and 67*b*.

In the three-cylinder rotary compressor 2, when the vapor-phase refrigerant is compressed in the first to third cylinder chambers 25, 26, and 29, a load is generated to press the rotating shaft 20 in the radial direction. A white arrow Y shown in FIG. 3 indicates a direction of the load that the rotating shaft 20 receives due to the load when the roller 51 compresses the vapor-phase refrigerant in the first cylinder chamber 25.

In the compression stroke in which the vapor-phase refrigerant is compressed, the load applied to the rotating shaft 20 varies depending on the rotation angle of the rotating shaft 20, and the load that the inner peripheral surface of the bearing hole 22 of the second intermediate partition plate 17 supporting the rotating shaft 20 receives also varies depending on the circumferential position of the bearing hole 22.

Figure 10:
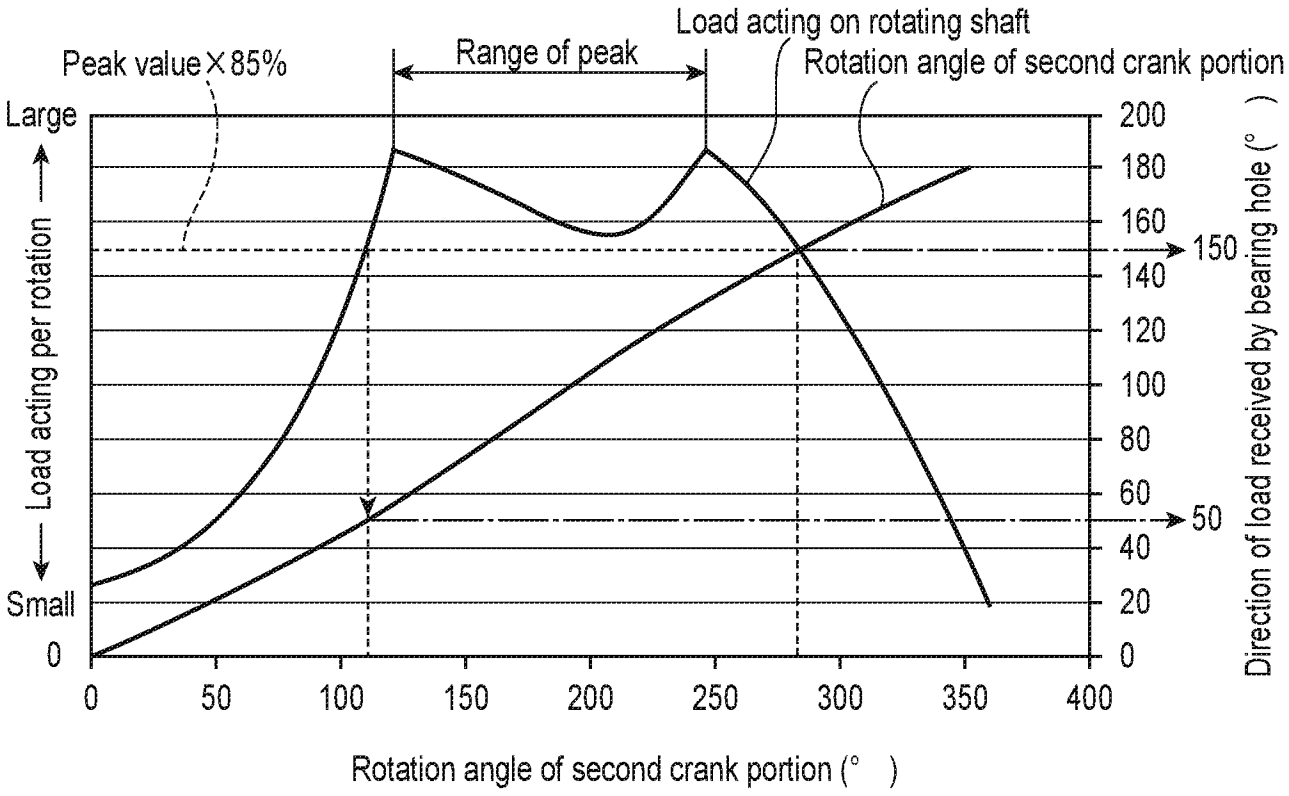
FIG. 10 is a characteristic view showing a relationship between a load acting on a rotary shaft and a rotation angle of the rotary shaft.

FIG. 10 shows a relationship between the rotation angle of the second crank portion 47*b* located on the upper side of the second intermediate partition plate 17 and the load acting on the rotating shaft 20, and the direction of the load which the inner peripheral surface of the bearing hole 22 receives when the load acts on the rotating shaft 20. The load acting on the rotating shaft 20 is the sum of the forces with which the first to third crank portions 47*a*, 47*b*, and 47*c* are pushed through the rollers 51, 52, and 53.

Furthermore, the rotation angle of the rotary shaft 20 is indicative of an angle in the rotation direction of the rotating shaft 20 when the eccentric direction of the second crank portion 47*b* is the direction of the vane 56 and the position where the vane 56 is most pushed into the vane slot 55 is referred to as the reference (0°).

As shown in FIG. 10, the load acting on the rotary shaft 20 reaches a peak when the rotation angle of the second crank portion 47*b* is approximately in the range of 120° to 250°, and decreases rapidly when the rotation angle exceeds 250°.

According to the present embodiment, the load acting on the rotary shaft 20 reaches 85% of the peak value when the rotation angle of the second crank portion 47*b* is approximately in the range of 110° to 280°. When the rotation angle of the second crank portion 47*b* is approximately 110°, the load acts on the bearing hole 22 of the second intermediate partition plate 17 in the direction of 50° in the rotation direction of the shaft 20, using a direction of the vane 56 as a reference position, as seen from the axial direction of the rotating shaft 20.

Furthermore, when the rotation angle of the second crank portion 47*b* is approximately 280°, the load acts on the bearing hole 22 of the second intermediate partition plate 17 in the direction of 150°.

FIG. 6 shows a positional relationship between the dividing line X and the vane 56, of the second intermediate partition plate 17 divided into two parts. As is apparent from FIG. 6, the dividing line X of the second intermediate partition plate 17 is provided at a position displaced from a range θ of 50° to 150° in the rotation direction of the rotating shaft 20, using the direction of the vane 56 as a reference position, as seen from the axial direction of the rotating shaft 20.

For this reason, the bonding surfaces 76*a* and 76*b* of the first plate element 75*a* and the second plate element 75*b* that define the dividing line X are provided at positions where the load acting on the bearing hole 22 from the rotating shaft 20 is 85% or less of the peak value.

According to the first embodiment, the center of gravity G of the structure including the rotor 14 of the electric motor 11 and the compression mechanism unit 12 is located on the axis of the first intermediate shaft portion 48 extending between the first crank portion 47*a* and the second crank portion 47*b*, within the range of the distance H between the first fixing portion 33 and the second fixing portion 38.

According to this configuration, when the vapor-phase refrigerant is compressed, the pressure fluctuation occurs in the three places of the first to third cylinder chambers 25, 26, and 29, but occurrence of large variations in the distance from the three places where the pressure fluctuation occurs to the center of gravity G can be avoided. Therefore, the compression mechanism unit 12 serving as a vibration source can be firmly supported by the sealed container 10 and the vibration of the compression mechanism unit 12 can be suppressed.

Therefore, the high-reliability three-cylinder rotary compressor 2 suppressing vibrations that cause noise and various troubles can be provided.

Furthermore, in the first embodiment, the second intermediate partition plate 17 also functions as the third bearing that rotatably supports the second intermediate shaft portion 49 of rotating shaft 20. For this reason, a bend and a shaft deflection of the rotating shaft 20 at the time of operation of the three-cylinder rotary compressor 2 can be suppressed, and this also contributes to the reduction of vibration and noise of the three-cylinder rotary compressor 2.

In addition, the dividing line X that passes through the bonding surfaces 76*a* and 76*b* of the second intermediate partition plate 17 is provided at a position deviating from the range θ of 50° to 150° in the rotation direction of the rotating shaft 20, using the direction of vane 56 as a reference position (reference point), as seen from the axial direction of the rotating shaft 20.

A slight step or the like is likely to occur at a bonding portion of the bearing hole 22 formed at the first recess portions 77*a* and 77*b*. However, by employing the above configuration, large load acting on the bonding portion of the bearing hole 22 can be avoided although the second intermediate partition plate 17 is divided into the first plate element 75*a* and the second plate element 75*b*. For this reason, wear of the bearing hole 22 and the second intermediate shaft portion 49 can be prevented.

Furthermore, since the second suction port 66 is located on the dividing line X, the second recess portions 78*a* and 78*b* formed on the bonding surfaces 76*a* and 76*b* of the first plate element 75*a* and the second plate element 75*b* cooperate to define the second suction port 66 when the bonding surfaces 76*a* and 76*b* are made to abut.

Figure 9:
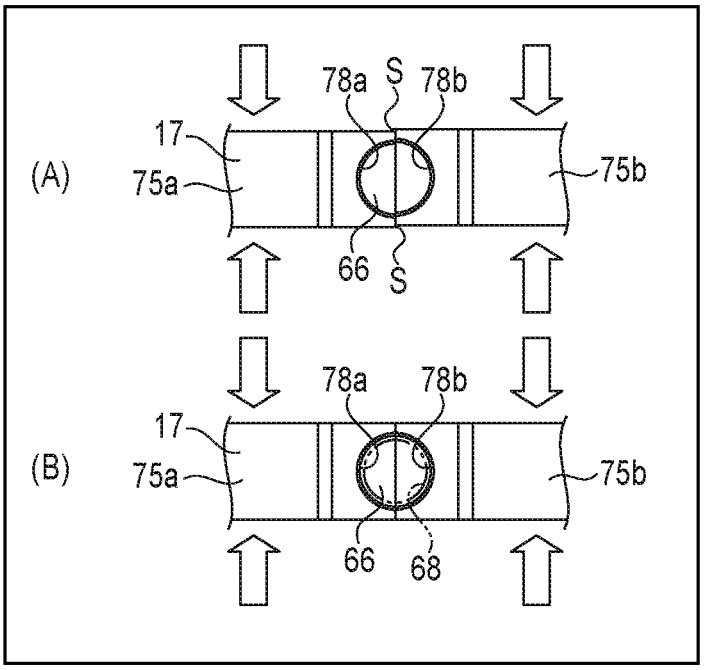
FIG. 9 (A) is side view showing a second intermediate partition plate, illustrating a state where a pair of plate elements are displaced in a thickness direction.

In this case, as shown by a white arrow in (A) of FIG. 9, a bolt fastening force is applied to the second intermediate partition plate 17 from the side of the second cylinder body 21*b* and the third cylinder body 21*c*. At this time, for example, when variations occur in the bolt fastening force, the first plate element 75*a* and the second plate element 75*b* are displaced in the thickness direction at the dividing line X and a minute step S may occur on the upper and lower surfaces of the second intermediate partition plate 17 as shown in (A) of FIG. 9.

The upper surface and the lower surface of the second intermediate partition plate 17 are sliding surfaces with which the rollers 52 and 53 are slidably in contact. Therefore, if a step is present on the sliding surfaces, it may be one of factors that cause the rollers 52 and 53 to be worn and cause the airtightness of the second cylinder chamber 26 and the third cylinder chamber 29 to be reduced.

In the present embodiment, the second suction pipe 68 is press-fitted into the second suction port 66 defined by the second recess portions 78*a* and 78*b* from the outside of the second intermediate partition plate 17, in a state where the second intermediate partition plate 17 is sandwiched between the second cylinder body 21*b* and the third cylinder body 21*c*.

The minute displacement which has occurred between the first plate element 75*a* and the second plate element 75*b* is corrected by the press-fitting, and the upper surface and the lower surface of the second intermediate partition plate 17 become flat surfaces having no step as shown in FIG. 9(B).

Therefore, wear of the rollers 52 and 53 can be avoided, the airtightness of the second cylinder chamber 26 and the third cylinder chamber 29 is improved, and the leakage of the vapor-phase refrigerant can be prevented.

The position of the dividing line X dividing the second intermediate partition plate 17 is not limited to the first embodiment. For example, as indicated by a symbol Z in FIG. 6, a dividing line may be provided at a position connecting the reference point B corresponding to the vane 56 and the center of the bearing hole 22. The position of the dividing line is not particularly limited as long as it deviates from the range θ of 50° to 150° in the rotation direction of the rotating shaft 20.

Furthermore, in the first embodiment, the second intermediate partition plate 17 also functions as the third bearing supporting the second intermediate shaft portion 49 of the rotating shaft 20 by forming the second intermediate partition plate 17 in a two-piece divisional structure. However, the present embodiment is not limited to this.

For example, by forming the first intermediate partition plate 16 in the two-piece divisional structure instead of the second intermediate partition plate 17, the first intermediate partition plate 16 may function as a third bearing which supports the first intermediate shaft portion 48 of the rotating shaft 20.

Second Embodiment

Figure 11:
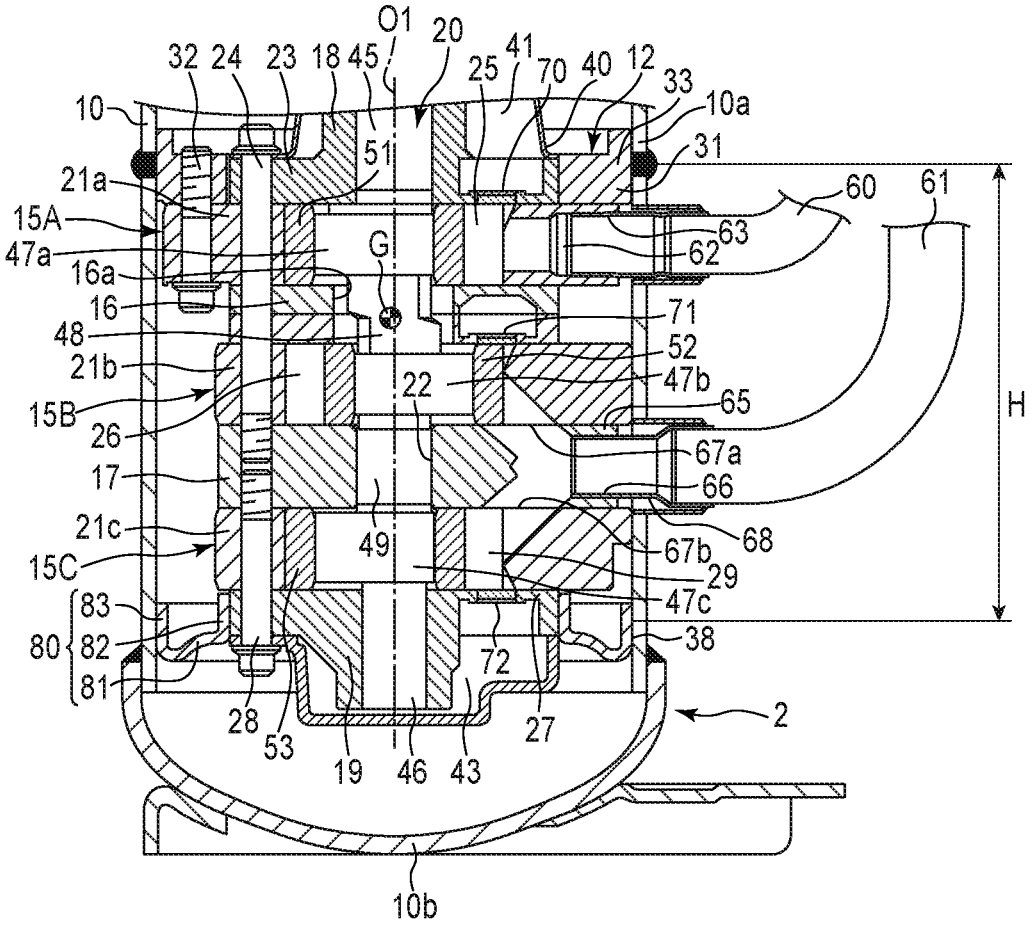
FIG. 11 is a cross-sectional view showing a three-cylinder rotary compressor according to a second embodiment.

FIG. 11 discloses a second embodiment. The second embodiment is different from the first embodiment with respect to a structure that the lower end part of the compression mechanism unit 12 is fixed to the sealed container 10. The configuration of the three-cylinder rotary compressor 2 other than this is the same as that of the first embodiment. For this reason, in the second embodiment, the same reference numerals are denoted to the same constituent portions as those of the first embodiment and their descriptions will be omitted.

As shown in FIG. 11, a second support member 80 constituting the second fixing portion 38 is interposed between the flange portion 27 of the second bearing 19 and the container body 10*a*. The second support member 80 comprises a ring portion 81 surrounding the flange portion 27, a cylindrical inner peripheral wall portion 82 rising from an inner peripheral edge of the ring portion 81, and a cylindrical outer peripheral wall portion 83 rising from an outer peripheral edge of the ring portion 81.

The inner peripheral wall portion 82 of the second support member 80 is press-fitted into the outer peripheral surface of the flange portion 27 of the second bearing 19 from below prior to the outer peripheral wall portion 83. The outer peripheral wall portion 83 of the second support member 80 is press-fitted into the inside of the container body 10*a* from the lower end opening of the container body 10*a* before closing the lower end opening of the container body 10*a* with the bottom member 10*b*.

Even in such a configuration, the lower end part of the compression mechanism unit 12 including the first to third refrigerant compression units 15A, 15B, and 15C is fixed to the sealed container 10 by the second fixing portion 38, and the center of gravity G of the structure including the rotor 14 of the electric motor 11 and the compression mechanism unit 12 is located within the range of the distance H between the first fixing portion 33 and the second fixing portion 38.

Third Embodiment

Figure 12:
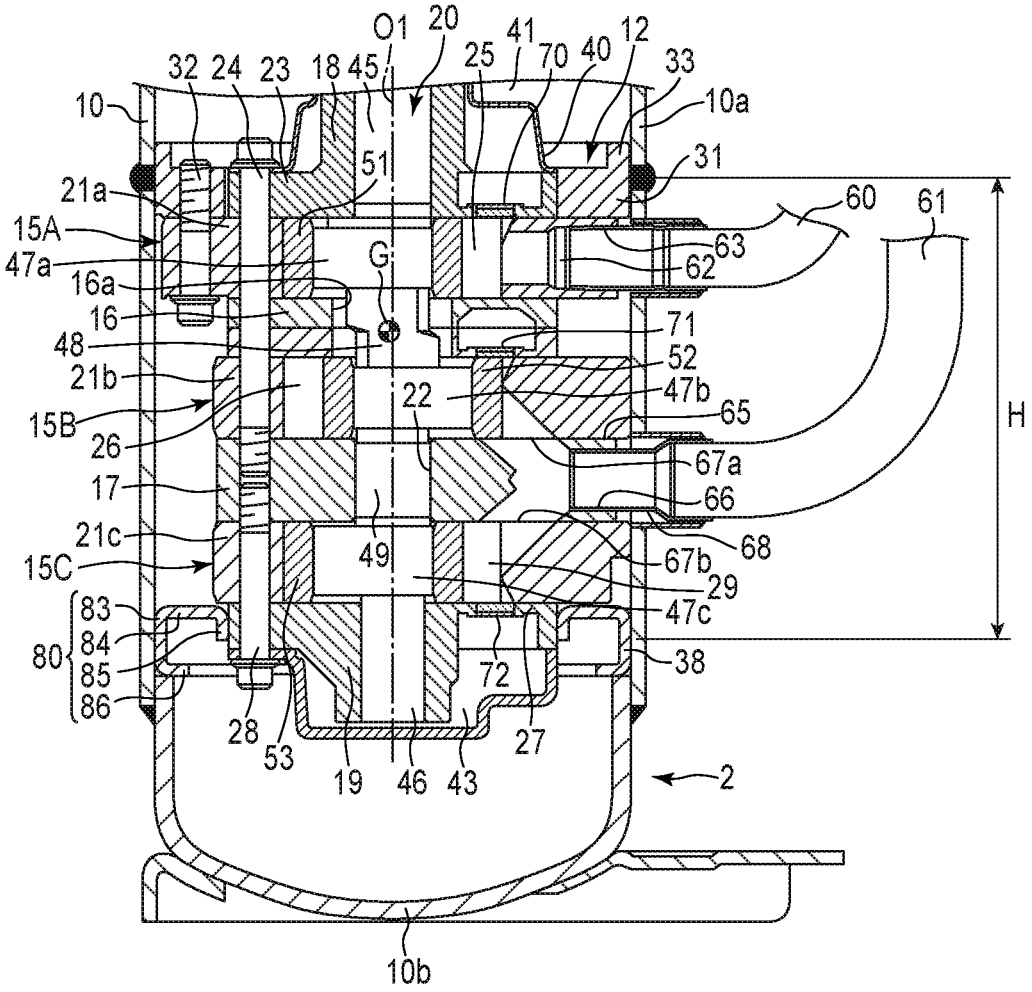
FIG. 12 is a cross-sectional view showing a three-cylinder rotary compressor according to a third embodiment.

FIG. 12 discloses a third embodiment. The third embodiment is different from the second embodiment with respect to an element relating to the shape of the second support member 80.

As shown in FIG. 12, the second support member 80 according to the third embodiment comprises a ring portion 84 that surrounds the flange portion 27, a cylindrical inner peripheral wall portion 85 that is folded downward from an inner peripheral edge of the ring portion 84, a cylindrical outer peripheral wall portion 86 that is folded downward from an outer peripheral edge of the ring portion 84, and a ring-shaped flange portion 87 that is folded inward from a lower end of the outer peripheral wall portion 86.

The inner peripheral wall part 85 of the second support member 80 is press-fitted into the outer peripheral surface of the flange portion 27 of the second bearing 19 from below prior to the outer peripheral wall portion 86. The outer peripheral wall portion 86 of the second support member 80 is press-fitted to the inside of the container body 10*a* from the lower end opening of the container body 10*a* before closing the lower end opening of the container body 10*a* with the bottom member 10*b*. The flange portion 87 abuts against the upper end part of the bottom member 10*b* when the lower end opening of the container body 10*a* is closed with the bottom member 10*b*.

Fourth Embodiment

Figure 13:
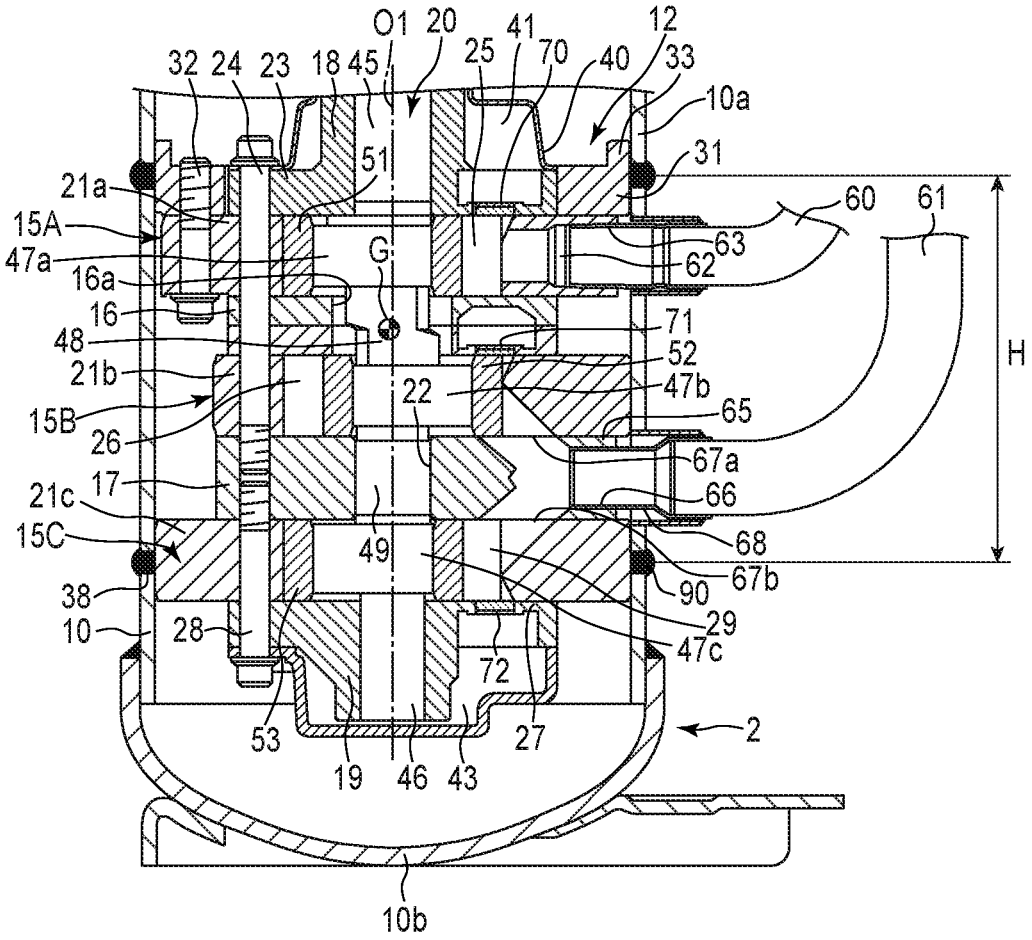
FIG. 13 is a cross-sectional view showing a three-cylinder rotary compressor according to a fourth embodiment.

FIG. 13 discloses a fourth embodiment. The fourth embodiment is different from the first embodiment with respect to a structure in which the lower end part of the compression mechanism unit 12 is fixed to the sealed container 10. The configuration of the three-cylinder rotary compressor 2 other than this is the same as that of the first embodiment. For this reason, in the second embodiment, the same reference numerals are denoted to the same constituent portions as those of the first embodiment and their descriptions will be omitted.

As shown in FIG. 13, the third cylinder body 21*c* has an outer peripheral surface formed along the inner peripheral surface of the container body 10*a*. The third cylinder body 21*c* is fitted into the inside of the container body 10*a*, and the outer peripheral surface thereof is directly fixed to a predetermined position of the container body 10*a* by means such as the welding.

For this reason, in the fourth embodiment, a welding portion 90 formed between the third cylinder body 21*c* and the container body 10*a* constitutes the second fixing portion 38 that fixes the lower end part of the compression mechanism unit 12 to the sealed container 10.

Even in such a configuration, the lower end part of the compression mechanism unit 12 including the first to third refrigerant compression units 15A, 15B, and 15C is fixed to the sealed container 10 by the second fixing portion 38, and the center of gravity G of the structure including the rotor 14 of the electric motor 11 and the compression mechanism unit 12 is located within the range of the distance H between the first fixing portion 33 and the second fixing portion 38.

Fifth Embodiment

Figure 14:
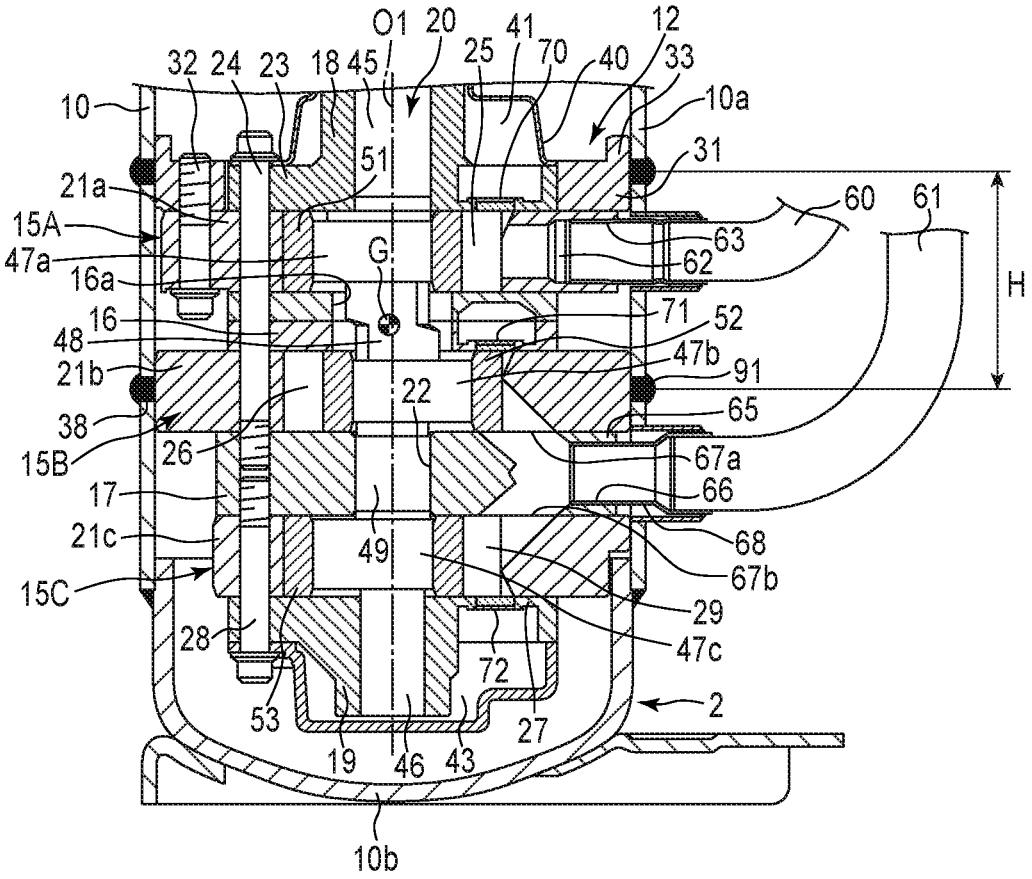
FIG. 14 is a cross-sectional view showing a three-cylinder rotary compressor according to a fifth embodiment.

FIG. 14 discloses a fifth embodiment. The fifth embodiment is different from the fourth embodiment with respect to a structure in which the lower end part of the compression mechanism unit 12 is fixed to the sealed container 10.

As shown in FIG. 14, the second cylinder body 21*b* has an outer peripheral surface formed along the inner peripheral surface of the container body 10*a*. The second cylinder body 21*b* is fitted into the inside of the container body 10*a*, and the outer peripheral surface thereof is directly fixed to a predetermined position of the container body 10*a* by means such as the welding.

For this reason, in the fifth embodiment, a welding portion 91 formed between the third cylinder body 21*c* and the container body 10*a* constitutes the second fixing portion 38 that fixes the lower end part of the compression mechanism unit 12 to the sealed container 10.

Even in such a configuration, the lower end part of the compression mechanism unit 12 including the first to third refrigerant compression units 15A, 15B, and 15C is fixed to the sealed container 10 by the second fixing portion 38, and the center of gravity G of the structure including the rotor 14 of the electric motor 11 and the compression mechanism unit 12 is located within the range of the distance H between the first fixing portion 33 and the second fixing portion 38.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A rotary compressor comprising:

a cylindrical sealed container;

a compression mechanism unit compressing a refrigerant inside the sealed container; and an electric motor including a stator fixed to an inner peripheral surface of the sealed container on an upper side of the compression mechanism unit and a rotor surrounded by the stator to drive the compression mechanism unit inside the sealed container, the compression mechanism unit comprising:

a first bearing and a second bearing arranged in intervals in an axial direction of the sealed container;

first to third refrigerant compression units arranged in intervals in an axial direction of the sealed container between the first bearing and the second bearing;

a first intermediate partition plate interposed between the first refrigerant compression unit and the second refrigerant compression unit;

a second intermediate partition plate interposed between the second refrigerant compression unit and the third refrigerant compression unit; and a rotary shaft including a first journal portion supported by the first bearing, a second journal portion supported by the second bearing, the first journal portion, first to third crank portions provided between the first journal portion and the second journal portion to eccentrically rotate in cylinder chambers of the first to third refrigerant compression portions and allow rollers to be fitted, a first intermediate shaft portion located between the first crank portion and the second crank portion, and a second intermediate shaft portion located between the second crank portion and the third crank portion, the rotary shaft having the rotor of the electric motor fixed and rotating, and the compression mechanism unit being fixed to the sealed container by a pair of fixing portions provided at two places spaced in an axial direction of the rotary shaft, a center of gravity of a structure including the compression mechanism unit and the rotor of the electric motor being located between the pair of fixing portions, wherein the center of gravity of the structure including the compression mechanism unit and the rotor of the electric motor is located on the axis of the first intermediate shaft portion.

2. The rotary compressor of claim 1, wherein one of the fixing portions is composed of a first support member which is fixed to an inner peripheral surface of the sealed container and to which the first refrigerant compression unit nearest to the electric motor is coupled, and the other fixing portion is composed of a second support member which is fixed to an inner peripheral surface of the sealed container and to which the third refrigerant compression unit farthest from the electric motor is coupled.

3. The rotary compressor of claim 1, wherein one of the fixing portions is composed of a first support member which is fixed to an inner peripheral surface of the sealed container and to which the first refrigerant compression unit nearest to the electric motor is coupled, and the other fixing portion is composed of a second support member interposed between an inner peripheral surface of the sealed container and an outer peripheral surface of the second bearing located at a lowermost part of the compression mechanism unit, and the second support member is press-fitted into the inner peripheral surface of the sealed container and the outer peripheral surface of the second bearing.

4. The rotary compressor of claim 1, wherein one of the fixing portions is composed of a support member which is fixed to an inner peripheral surface of the sealed container and to which the first refrigerant compression unit nearest to the electric motor is coupled, and the other fixing portion is composed of a welding portion formed between an outer peripheral portion of the second refrigerant compression unit and the sealed container or between the third refrigerant compression unit and the sealed container.

5. The rotary compressor of claim 1, wherein each of the first to third refrigerant compression units of the compression mechanism unit includes a vane dividing the cylinder chamber into a suction region and a compression region, one of the first intermediate partition plate and the second intermediate partition plate is composed of a pair of plate elements divided along a radial direction of the rotating shaft, and the plate elements include bonding surfaces which are made to abut against each other and include first recess portions defining bearing holes which rotatably support the first intermediate shaft portion or the second intermediate shaft portion of the rotating shaft, and the bonding surfaces of the plate elements are provided at locations deviating from a range of 50° to 150° in a rotation direction of the rotating shaft, using a direction of the vane as a reference point, as seen from an axial direction of the rotating shaft.

6. The rotary compressor of claim 5, wherein the bonding surfaces of the plate elements are composed of perpendicular surfaces along the axial direction of the rotating shaft, second recess portions are formed on the bonding surfaces of the plate elements, the second recess portions define a suction port which cooperate to lead a refrigerant to the cylinder chambers when the bonding surfaces are made to abut, and a connection pipe is press-fitted into the suction port.

7. A refrigeration cycle apparatus comprising:

a circulation circuit having a refrigerant circulated and being connected to a radiator, an expansion device, and a heat absorber; and the rotary compressor of any one of claims 1 to 6 connected to the circulation circuit between the radiator and the heat absorber.

* * * * *